United States Patent [19]

Okada et al.

[11] Patent Number: 4,879,886

[45] Date of Patent: Nov. 14, 1989

[54] CIRCULAR KNITTING MACHINE

[75] Inventors: Toshihiko Okada; Toshifumi Yagi; Satoshi Suzuki, all of Kyoto, Japan

[73] Assignee: Gunze Limited, Ayabe, Japan

[21] Appl. No.: 186,636

[22] Filed: Apr. 27, 1988

[30] Foreign Application Priority Data

| | | | |
|---|---|---|---|
| May 1, 1987 | [JP] | Japan | 62-109554 |
| Jul. 17, 1987 | [JP] | Japan | 62-110140[U] |
| Aug. 4, 1987 | [JP] | Japan | 62-195039 |
| Oct. 19, 1987 | [JP] | Japan | 62-160576[U] |

[51] Int. Cl.[4] ..... D04B 15/88

[52] U.S. Cl. ..... 66/151; 66/153

[58] Field of Search ..... 66/8, 149 R, 151, 152, 66/153

[56] References Cited

U.S. PATENT DOCUMENTS

| | | | |
|---|---|---|---|
| 2,870,618 | 1/1959 | Zeruneith | 66/152 |
| 3,695,062 | 10/1972 | Schaack | 66/151 |
| 3,839,885 | 10/1974 | Bourgeois | 66/151 |
| 3,872,692 | 3/1975 | Miyagawa et al. | 66/151 |
| 4,079,600 | 3/1978 | Amaya et al. | 66/151 X |
| 4,236,390 | 12/1980 | Blank et al. | 66/149 R |
| 4,765,157 | 8/1988 | Okada | 66/151 |

FOREIGN PATENT DOCUMENTS

| | | | |
|---|---|---|---|
| 59-88955 | 5/1984 | Japan . | |
| 63-7185 | 1/1988 | Japan . | |
| 8502633 | 6/1985 | PCT Int'l Appl. | 66/151 |
| 2118979 | 11/1983 | United Kingdom | 66/151 |

*Primary Examiner*—Wm. Carter Reynolds

*Attorney, Agent, or Firm*—Sixbey, Friedman, Leedom & Ferguson

[57] ABSTRACT

A circular knitting machine comprising a knitting assembly for forming a tubular knitted fabric, fabric transport rollers for delivering the fabric from the assembly, a take-up spool for rolling up the delivered fabric thereon, and a pair of opposed frames stoppably rotatable about a vertical axis in synchronism with the knitting assembly. The rollers and the spool are supported by the frames. A constant torque is transmitted from a drive transmission for the frames to the transport rollers by a constant-torque transmission utilizing a magnetic force, while the spool is driven with power transmitted from the drive transmission through a belt transmission, so that the fabric knitted at a high speed can be rolled up properly. The spool comprises a pair of divided spool members and is therefore easily withdrawable from the rolled-up fabric.

17 Claims, 15 Drawing Sheets

Fig. 17
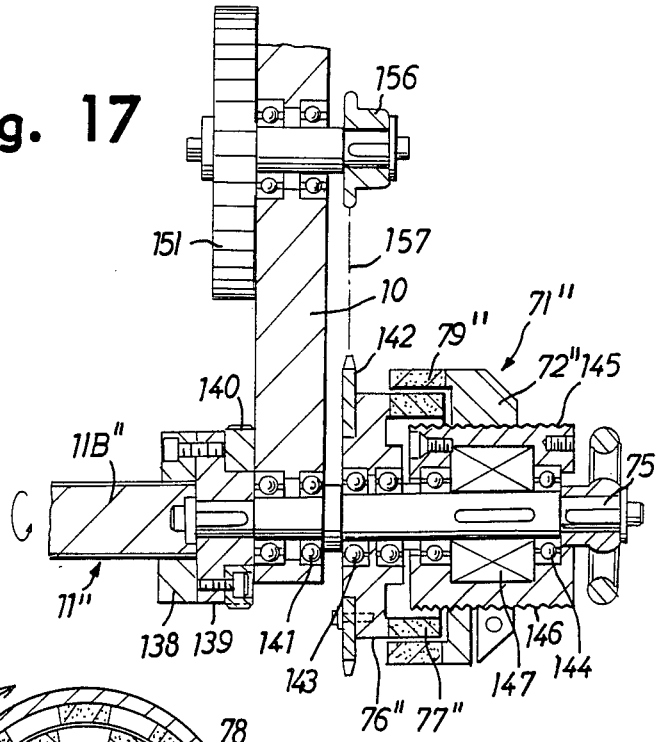
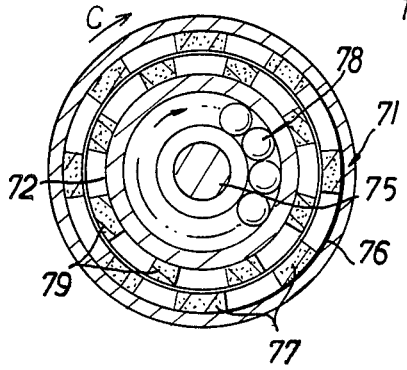
Fig. 7

CIRCULAR KNITTING MACHINE

FIELD OF THE INVENTION AND RELATED ART STATEMENT

The present invention relates to a circular knitting machine, and more particularly to techniques for transporting the fabric knitted by the machine to a take-up assembly and for rolling up the transported fabric on the take-up assembly.

The tubular fabric knitted by a circular knitting machine is delivered downward from the machine through the center of the lower needle bed and rolled up on the take-up spool of a take-up apparatus disposed below the knitting machine and rotatable in synchronism therewith as disclosed, for example, in Unexamined Japanese Patent Publication SHO No. 59-88955, U.S. Pat. No. 3,839,885, U.S. Pat. No. 4,079,600, etc.

With the conventional techniques, the fabric transport roll is driven by the meshing engagement of a ratchet mechanism with a gear to intermittently transport the fabric, so that there is a limitation to the speed of transport of the fabric. Moreover, the drive means is complex in construction and is not suited to the transmission of a constant torque.

The take-up spool is driven by sprockets and a chain reeved therearound and therefore requires an arrangement of complex construction. Further since the knitted fabric is highly flexible, the sprocket-chain transmission system is unable to roll up the fabric with freedom and has the problem of failing to compensate for a reduction in the rolling-up tension due to an increase in the diameter of the rolled-up fabric.

OBJECTS AND SUMMARY OF THE INVENTION

A first object of the present invention is to provide a circular knitting machine wherein the tubular fabric formed by knitting means is delivered therefrom in a hanging position by fabric transport means which comprises a plurality of rollers drivingly rotatable in the fabric transport direction by constant-torque transmission means resorting to a magnetic force so that the fabric can be knitted and rolled up at a high speed.

A second object of the invention is to provide a circular knitting machine of the type described wherein the rollers of the fabric transport means are drivingly rotatable at a high speed by the constant-torque transmission means resorting to a magnetic force, the machine further comprising a take-up spool which is drivingly rotatable in the fabric rolling-up direction by belt transmission means so that the knitted fabric formed at a high speed, even if highly flexible, can be accurately and easily rolled up under the rolling-up tension.

A third object of the invention is to provide a circular knitting machine of the type described wherein the take-up spool comprises a pair of opposed divided hollow spool members which are withdrawable from the rolled-up fabric to assure ease of handling, the machine having take-up frames which are made free of a great local moment.

A fourth object of the invention is to provide a circular knitting machine wherein the fabric can be delivered from the knitting means and rolled up at a high speed to achieve improved productivity and which comprises shock-absorbing means for reducing the likelihood that the take-up assembly will rotate under inertia when brought out of operation, the machine thus assuring safety and precluding the fabric from twisting.

To fulfill the first object described, the present invention provides a circular knitting machine which comprises knitting means for forming a tubular knitted fabric, fabric transport means including a plurality of rollers for delivering the knitted fabric from the knitting means, take-up spool means for rolling up the knitted fabric delivered in a hanging state by the transport means, and a pair of opposed take-up frames stoppably rotatable about .a vertical axis in synchronism with the knitting means the rollers of the transport means being supported by the upper portions of the take-up frames, the take-up spool means being supported by the lower portions of the take-up frames. The knitting machine has the following features.

First, the knitting machine is characterized in that there is provided constant-torque transmitting means for magnetically transmitting a constant torque from drive transmission means for the take-up frames to the fabric transport means to drive the rollers thereof in a direction to transport the fabric.

To fulfill the second object, the knitting machine having the first feature is further characterized in that belt transmission means drives the take-up spool means in a direction to roll up the fabric thereon with power received from the drive transmission means for the take-up frames.

To fulfill te third object, the knitting machine having the first and second features is further characterized in that the take-up spool means comprises a pair of opposed divided hollow spool members, one of the spool members being internally provided with an engaging portion, the other spool member having engageable portions projecting from its end and movable radially away from its axis, the engageable portions being fittable into the engaging portion in engagement therewith and withdrawable therefrom.

To fulfill the fourth object, the knitting machine having the first feature is further characterized in that the drive transmission means for the take-up frames is provided with shock-absorber means for controlling the force of inertia of the take-up frames when the knitting machine is stopped.

BRIEF DESCRIPTION OF THE DRAWINGS

FIG. 7 is a view in section taken along the line VII—VII in FIG. 6;

FIG. 17 is a fragmentary sectional view showing an aspect of the FIG. 15 embodiment;

DESCRIPTION OF THE PREFERRED EMBODIMENTS

Embodiments of the invention will be described below with reference to the drawings.

Figure 1:
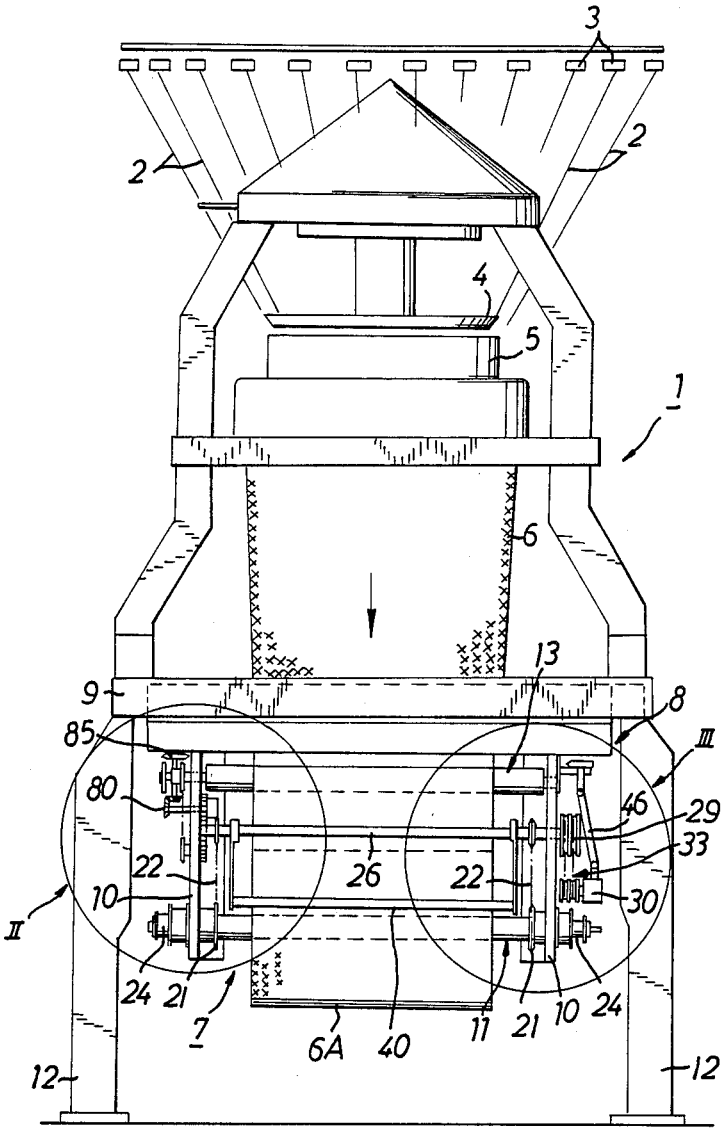
FIG. 1 is a front view showing a circular knitting machine embodying the invention.

FIG. 1 shows a circular knitting machine 1 which comprises means 3 for feeding yarns 2, and knitting means including an upper needle bed 4, a lower needle bed 5, etc. for forming a tubular knitted fabric 6. The fabric 6 is delivered downward in a hanging state.

Disposed below the knitting means is a rolling-up apparatus that is stoppably rotatable about a vertical axis in synchronism with the knitting means.

The rolling-up apparatus 7 comprises a support 9 incorporating drive transmission means 8 rotatable on a horizontal plane, a pair of opposed take-up frames 10 that are secured at their upper ends to the drive transmission means 8 and extend downward, and take-up spool means 11, that is rotatable about the longitudinal axis thereof and are horizontally supported by the lower portions of the take-up frames 10 for rolling up thereon the tubular fabric 6 as inserted through the support 9.

The rolling-up apparatus 7 has its drive transmission means 8 stoppably rotated in synchronism with the knitting means, whereby the pair of take-up frames 10 are stoppably rotated. Moreover, the take-up spool means 11 supported by the frames 10 are rotated about the axis of rotation of the frames 10 so that the fabric 6 continuously knitted into a tube and hanging can be rolled up without twisting.

The support 9 is in the form of a ring when seen from above and is supported by three legs 12. The roll of fabric is removable outward from the rolling position from between the three legs 12.

Figure 2:
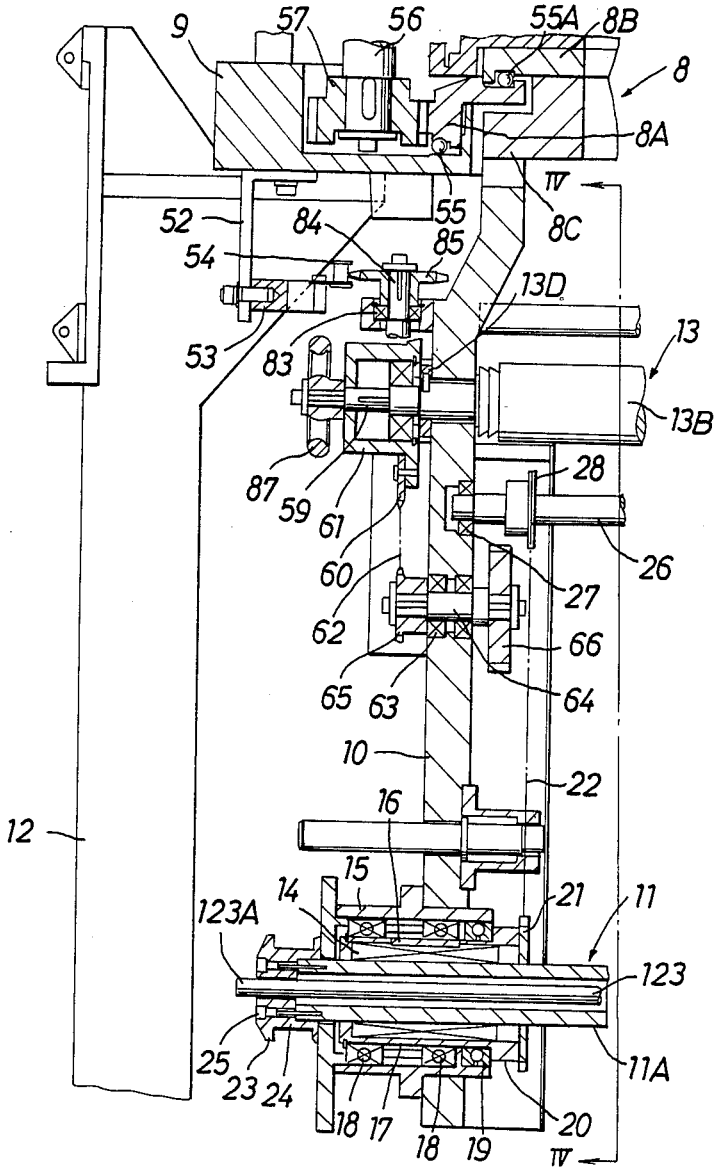
FIG. 2 is an enlarged view in section showing the portion II of FIG. 1.

The take-up spool means 11 comprises a pair of opposed divided spool members 11A, 11B and has each of its outer ends supported by the lower end of the frame 10 by means of a slide bearing 14, bearing box 15, etc. which are adapted to transmit torque as seen in FIG. 2. A transmission sleeve 17 housed in the box 15 is rotatably supported by two radial bearings 18 and a thrust bearing 19. The slide bearing 14 is housed in and keyed to the sleeve 17 as at 16. Each of the pair of sleeves 17 is provided at its inner end with a flange 20 in contact with the thrust bearing 19. A spool drive sprocket 21 is secured to the inner end of the flange 20 and has a transmission chain 22 reeved therearound.

Fastened by a bolt 25 to the outer end of each of spool members 11A, 11B is a tubular member 24 having a flange 23 that is engageable by a hook member of a withdrawing means.

A spool interlocking shaft 26 is positioned below the rear side of the fabric transport means 13 and is supported by bearings 27 on the opposed frames 10 to rotate about a horizontal axis. Sprockets 28 for rotating the two spool members together are fixed to the shaft 26 at positions close to the frames 10 in corresponding relation to the respective sprockets 21. The chain 22 is reeved around each pair of vertically opposed sprockets. The interlocking shaft 26 has one end 26A extending through the right take-up frame 10 and fixedly carries a pulley 29. A drive pulley 31 is keyed to the output shaft of a reduction gear 30 mounted on the right frame 10 and positioned immediately above the spool member 11B of the spool means 11. Force is transmitted from the pulley 31 to the pulley 29 by a belt 32. The pulleys 29, 31, belt 32, etc. provide belt transmission means 33 for driving the take-up spool means 11, so that through the stretching or contraction of the belt 32 and by controlling the tension thereon, force transmission can be realized optimally with increased freedom, such that a reduction in tension due to an increase in the diameter of the rolled-up fabric 6A can be compensated for by increasing the tension on the belt 32 to assure smooth take-up operation. The belt transmission means 33 is provided with an idler pulley 34 and a tension pulley 35.

The tension pulley 35 is mounted on the lower end of a pivotal arm 37 that is movably supported at its upper end by a horizontal rod 36 on the right frame 10. The rod 36 extends through the right frame 10 toward the left frame 10 and has an inner end 36A. A drive arm 38 is fixed to and suspended from the rod end 36A in parallel to the pivotal arm 37. The drive arm 38 is operatively connected by a spring 42 to a roll support arm 41 supported at its upper end by a bearing 39 on the interlocking shaft 26 and pivotally movably suspended from the shaft 26. The arm 41 carries a fabric holding roll 40 at its lower end.

Figure 5:
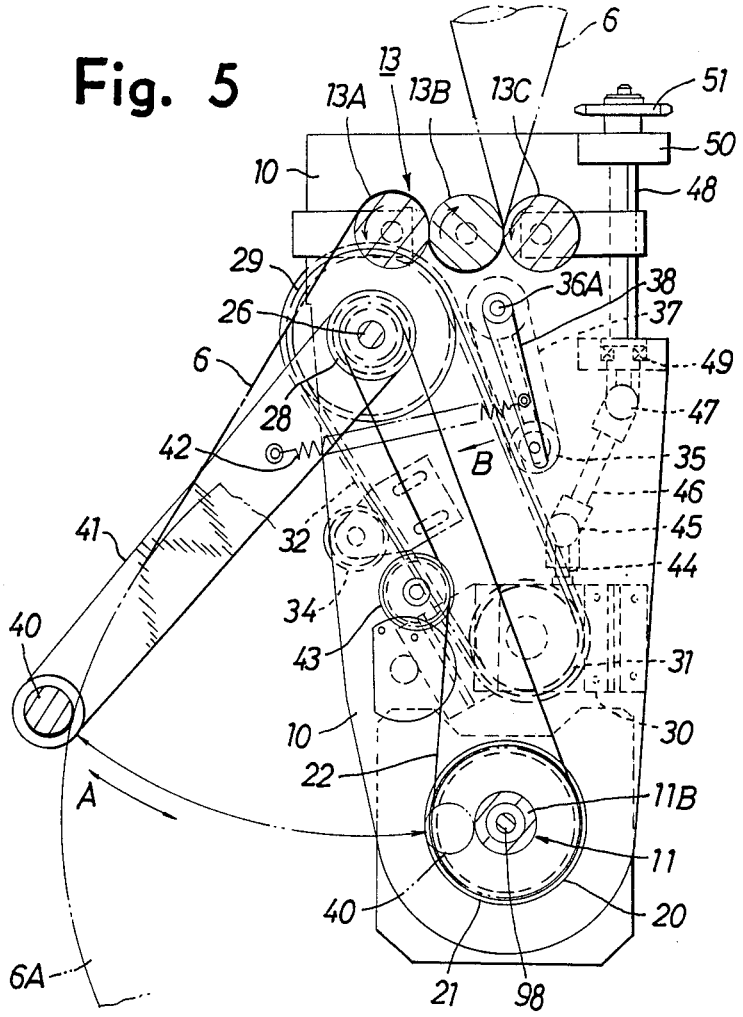
FIG. 5 is a view showing the same as it is seen in the direction of arrows V—V in FIG. 3.

Accordingly, as the support arm 41 moves as indicated by an arrow A in FIG. 5 with an increase in the diameter of the roll of fabric 6A, the drive arm 38 and the pivotal arm 37 are pulled in the direction of arrow B in FIG. 5 following this movement to give increased tension to the drive belt 32 and prevent the decrease in the tension on the fabric.

A take-up sprocket 43 is in engagement with the transmission chain 22.

Figure 3:
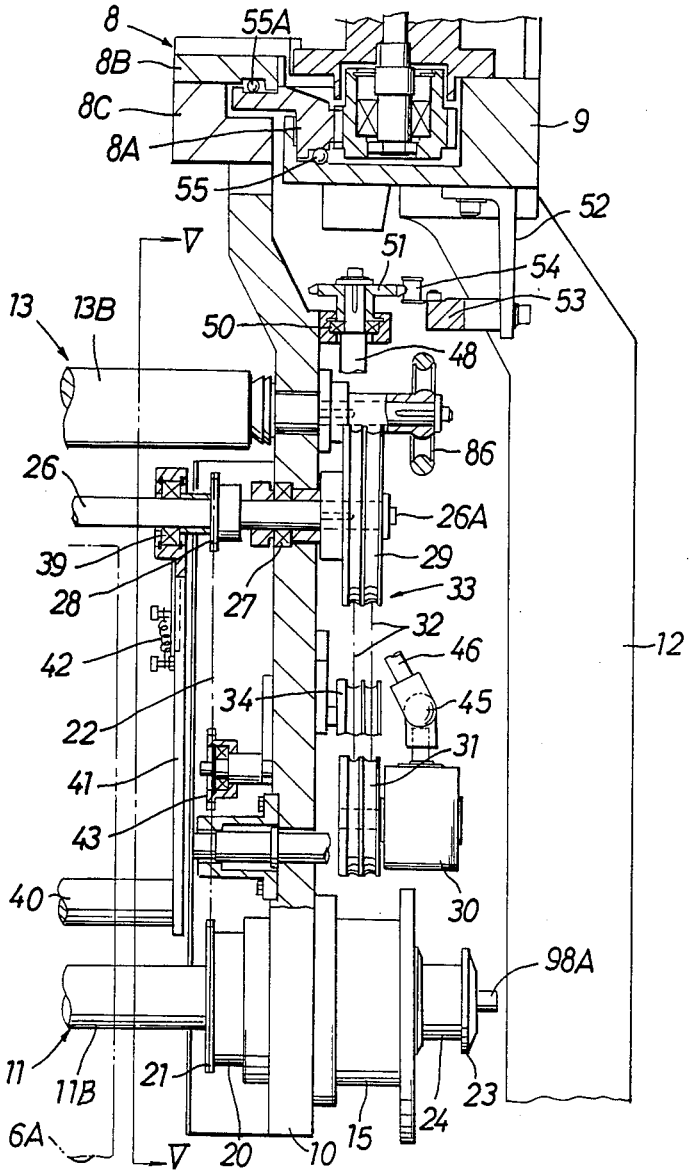
FIG. 3 is an enlarged view in section showing the portion III of FIG. 1.
Figure 4:
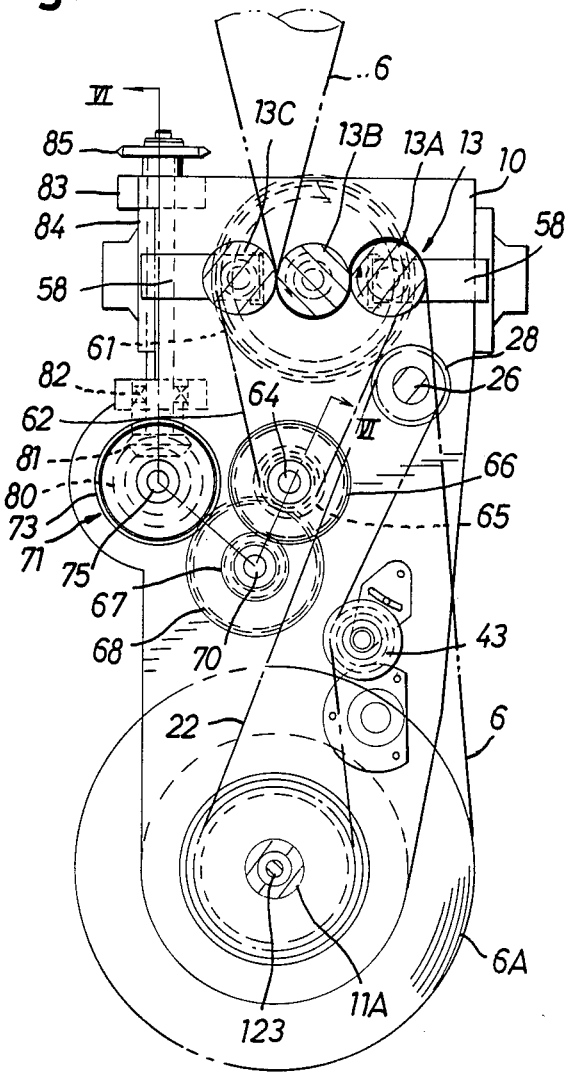
FIG. 4 is a view showing the embodiment as it is seen in the direction of arrows IV—IV in FIG. 2.

The reduction gear 30 has an input shaft 44 which is connected to a transmission shaft 48 by a universal joint 45, intermediate shaft 46 and universal joint 47. As seen in FIGS. 3 and 5, the shaft 48 extends vertically and is supported by bearings 49, 50 on the outer side of the right frame 10. A transmission sprocket 51 is keyed to the upper end of the shaft 48.

The sprocket 51 is positioned inside of and engaged with an annular chain 54 that is attached to the lower side of the support 9 by suspending brackets 52 and a support ring 53. The rotation of the take-up frame 10 causes the sprocket 51 to be rotated by the fixed annular chain 54.

With reference to FIG. 2, the drive transmission means 8 comprises a ring gear 8A and an annular take-up base 8B. The ring gear 8A is rotatably supported by a bearing 55 on the support 9. A drive shaft 56 supported by the support 9 has keyed to its lower end a pinion 57 meshing with the ring gear 8A, which in turn is driven by the pinion 57.

Thus, the pinion 57 drives both the knitting means and the drive transmission means 8.

The annular take-up base 8B is rotatably supported by a bearing 55A on the ring gear 8A. The frames 10 are attached to the base 8B by a bracket 8C.

The fabric transport means 13 comprises three rollers 13A, 13B and 13C. The central roller 13B serving as a drive roller, is supported by the right and left take-up frames 10. The front and rear rollers 13A, 13C which are driven rollers are supported by slide blocks 58 which are slidable forward or rearward and are thereby adjustable in position. The central roller 13B, when driven, rotates the front and rear rollers 13A, 13C in the fabric transportion direction through a gear transmission means 10D.

The central roller 13B has a shaft portion 59 extending outward from the left frame 10 and is provided with a one-way clutch 61 for transmitting torque only in the fabric transport direction. A transmission chain 62 is reeved around a ring sprocket 60 formed around the outer periphery of the clutch 61. A horizontal shaft 64 is positioned immediately below the roller 13B and rotatably supported by a bearing 63 on the left frame 10. The chain 62 is also reeved around a sprocket 65 keyed to the shaft 64. A reduction gear 66 keyed on the inner end of the horizontal shaft 64 is in mesh with a pinion 67 which is keyed along with an intermediate gear 68 to an intermediate gear shaft 70 that is supported by a bearing 69 on the left frame 10. The intermediate gear 68 is in mesh with a transmission gear 73 fastened to a driven ring 72 included in constant-torque transmission means 71.

Figure 6:
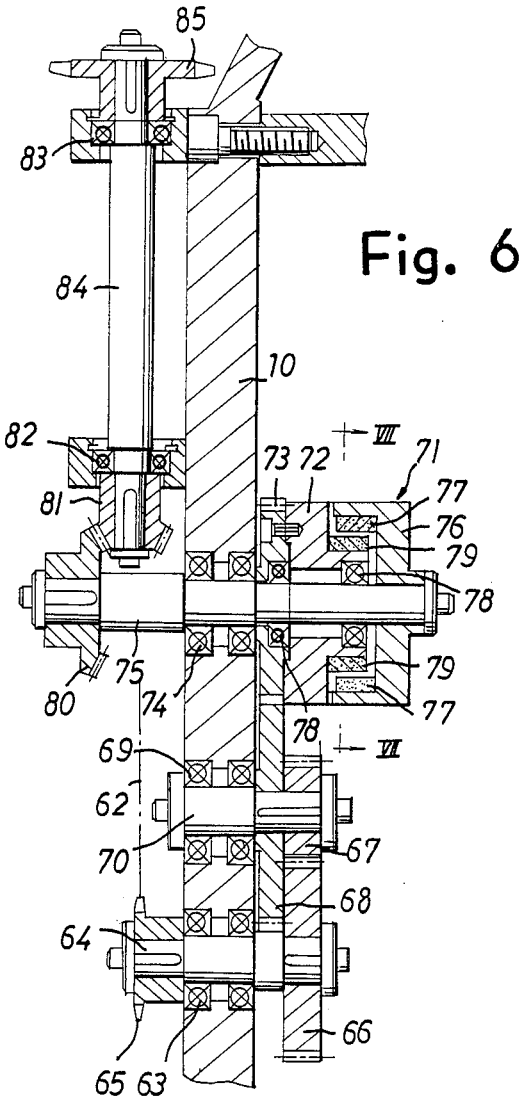
FIG. 6 is a view in section showing constanttorque power transmission means in detail.

With reference to FIGS. 6 and 7, the constant-torque transmission means 71 resorting to a magnetic force comprises a horizontal transmission shaft 75 extending through the left frame 10 and supported by a bearing 74 thereon, a drive ring 76 keyed to the inner end of the shaft 75, a multiplicity of permanent magnets 77 provided on the inner periphery of the ring 76, the above-mentioned driven ring 72 rotatably supported by a bearing 78 on the shaft 75, and a multiplicity of permanent magnets 79 provided on the outer periphery of a small-diameter portion of the ring 72. The permanent magnets 77 on the inner periphery of the drive ring 76 are arranged at a specified spacing circumferentially thereof and have their N poles positioned radially inwardly of the ring 76, with their S poles located radially outward. The magnets 79 on the driven ring 72 are equal in number to the number of magnets 77 and are arranged at a specified spacing circumferentially of the ring 72. The magnets 79 have their N poles positioned radially outward of the ring 72, with their S poles located radially inward.

The permanent magnets 79 on the driven ring 72 are positioned radially inwardly of, and out contact with, the permanent magnets 77 on the drive ring 76, with the same poles (which are N poles in the present embodiment but can be S poles) opposed to each other and positioned out of phase with each other circumferentially of the rings.

Accordingly, when the drive ring 76 is rotated in the direction of arrow C shown in FIG. 7, magnetic repellency occurs between the magnets 77 on the ring 76 and the magnets 79 on the driven ring 72, whereby the driven ring 72 is rotated in the direction of arrow C, with a clearance maintained between the opposed magnets as illustrated. Consequently, a constant torque is transmitted to the transport roller 13B via the gear reduction means 73, 66, 68, the wrapping connector reduction means 60, 62, 65, etc., rotating the roller in the fabric transport direction and causing the means 13 to transport the fabric 6 to the take-up spool means 11.

When an excessive load occurs, slippage occurs between the magnets 77 and 79 which act as a magnetic slip coupling to release the load.

The axial lap between the magnets 77, 79 is adjustable by shifting the drive or driven ring 76 or 72 axially thereof.

Figure 14:
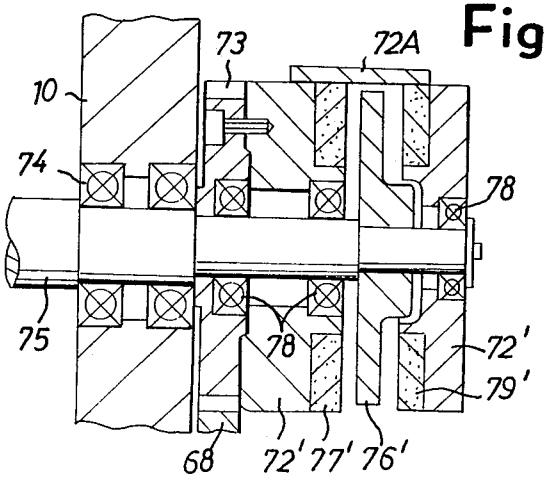
FIG. 14 is a sectional view showing another example of constant-torque transmission means.
Figure 8:
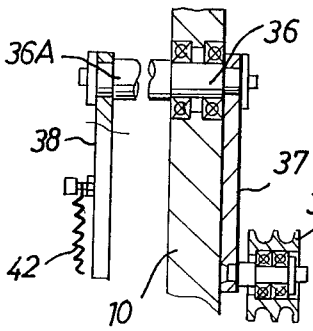
FIG. 8 is a front view showing a tension pulley and a drive system therefor.

FIG. 14 shows another embodiment of constant-torque transmission means 71 resorting to a magnetic force.

With reference to FIG. 14, a transmission shaft 75' is fixedly provided with a disk (corresponding to the drive ring 76) 76' of magnetic material, and a pair of driven disks 72', 72' having permanent magnets 77', 79', respectively are disposed at opposite sides of the disk 76' and rotatably supported by bearings 78. The pair of driven disks 72' are made rotatable together by a connector 72A.

When the disk 76' is rotated, lines of magnetic force act against the rotation. The force acting against the rotation is dependent on the arrangement of the magnetic poles, thus permitting stepless torque adjustment.

A bevel gear 80' keyed to the horizontal transmission shaft 75' at its outer end is in mesh with a bevel gear 81 which is keyed to the lower end, of a vertical transmission shaft 84 that is rotatably supported by bearings 82, 83 on the outer side of the left take-up frame 10. Keyed to the upper end of the shaft 84 is a transmission sprocket 85, that is in engagement with the annular chain 54.

Accordingly, the torque of the transmission sprocket 85 rotating in engagement with the annular chain 54 with the rotation of the drive transmission means 8 afforded by the ring gear is delivered to the constant-torque transmission means 71 via the transmission shaft 84, the bevel gears 81, 80 and the horizontal transmission shaft 75. The torque from the means 71 is increased by the reduction gear means 73, 68, 67, 66, then transmitted through the wrapping connector reduction means comprising the sprocket 65, chain 62, ring sprocket 60, etc. and through the one-way clutch 61 and delivered to the shaft portion 59 of the central roller 13B of the fabric transport means 13. The torque drives the driven rollers 13A, 13C through the gear transmission means 13D. Thus, the transport means 13 is rotated by a constant torque by virtue of the combination of the mechanical transmission means comprised of sprocket 85, shaft 84, gears 81, 80 and shaft 75, and the magnetic constant-torque transmission 71.

In this way, the torque is transmitted to the take-up spool means 11 and the fabric transport means 13 through different drive systems.

Indicated at 86, 87 are manual handles keyed to the respective shaft ends of the transport roller 13B for use in eliminating a slack from the fabric.

FIGS. 9 to 12 show the take-up spool means 11 in greater detail. The spool means 11 comprises divided spool members 11A, 11B, to the opposed end portions which spool end portions 89, 90 housing engagement means 88 are connected by bolts 91, 92, respectively. The spool end portions 89, 90 are adapted to be joined together end-to-end concentrically.

Figure 12:
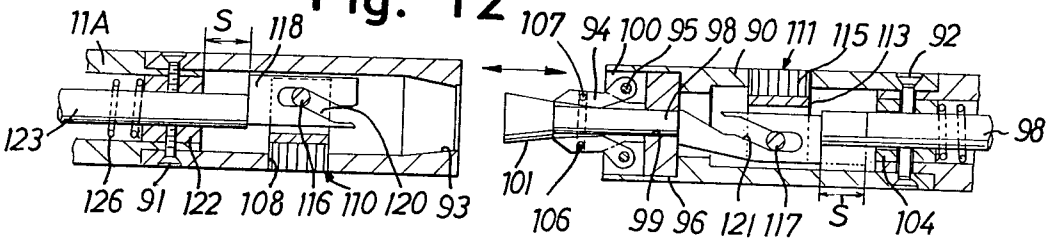
FIG. 12 is a fragmentary view in vertical section showing divided spool members as separated from each other.

The engagement means 88 has the following construction. The spool end portion 89 of the spool member 11A is formed with a socket providing an engaging part 93 that tapers toward its outer end. A radially expansible stud is formed by four engageable members 94 that are attached to a mount 96 by pins 95 and are each pivotally radially movable about a respective pin. The mount 96 is disposed within the spool portion 90 of the other spool member 11B at a position close to its outer end and is fastened to the portion 90 by bolts 97, with the outer ends of the engageable members 94 projected from the outer end of the spool portion 90. As seen in FIG. 12, the mount 96 is centrally formed with a slide bore 99 for an operating rod 98 and has four mount brackets 100 generally V-shaped when seen from one side and formed around its central portion at equal angular spacings. The base end of the engageable member 94 is fitted in each bracket 100 and pivoted thereto by the pin 95. The operating rod 98 is provided at its inner end with a pressing member 101 which is tapered toward the outer end of the rod 98 (i.e. leftward in FIGS. 9 and 12). The pressing member 101 is adapted to press the engageable members 94 against the engaging portion 93 and hold the members 94 in engagement with the portion 93. The engaging portion 93 and the pressing member 101 have the same taper angle. In corresponding relation thereto, the forward end engageable portion of the assembly of the members 94 has inner and outer surfaces of the same taper angle as above. The outer end 98A of the operating rod 98 is projected from the engaging flange 23 at the outer end of the spool member 11B by an amount equal to or slightly greater than the amount S of sliding movement of the rod 98. A coiled spring 105 is provided around the rod 98 between a slide guide 102 within the spool member 11B and a spring retainer 104 fastened to the rod 98 by a pin 103 for always biasing the operating rod toward its outer end to press the engageable members 94 against the engaging portion 93 and thereby maintain the engagement therebetween. A recess 106 is formed in the outer side of the engageable end portion of each engageable member 94. A ring of coiled spring 107 is fitted around the members 94 in the recesses 106 for biasing the members 94 into pressing contact with the pressing member 101 at all times.

The slide guide 102 is annular, is positioned in an inner end portion of the spool member 11B and is fastened thereto along with the spool end portion 90 by the bolt 92.

Figure 11:
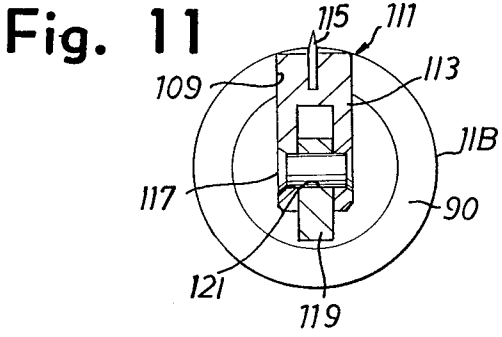
FIG. 11 is a view in section taken along the line XI—XI in FIG. 9.
Figure 10:
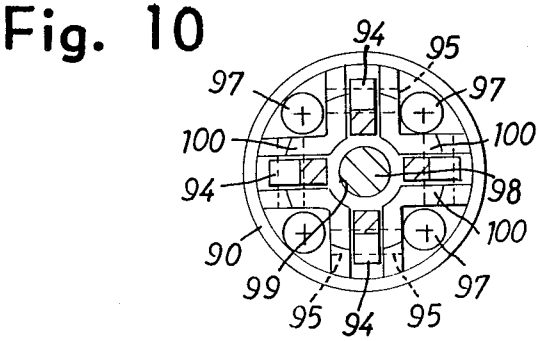
FIG. 10 is a view in section taken along the line X—X in FIG. 9.

The spool end portion 89 (90) of each spool member 11A (11B) is formed in its peripheral wall with a square hole 108 (109) having needle means 110 (111) fitted therein projectably. With reference to FIG. 11 showing the needle means 111 (110), the needle means comprises a block 113 (112) which is bifurcated when seen from one side, and a multiplicity of needles 115 (114) implanted in the block. A pin 117 (116) provided across the bifurcated portion of the block 113 (112) is fitted in a slanting groove 121 (120) formed in a projecting-retracting cam 119 (118). The cam 119 within the spool member 11B is provided as an intermediate portion of the operating rod 98 to project the needles 115 when the engageable members 94 are forced outward for engagement by sliding the rod 98 or to retract the needles 115 into the hole 109 when the engageable members 94 are moved radially inward for disengagement.

The cam 118 within the other spool member 11A is secured to the inner end of an operating rod 123 which is axially slidable by being guided by an annular slide guide 122. The guide 122 is disposed within the spool member 11A and fixed thereto along with the spool end portion 89 by the bolt 91. The rod 123 has an outer end 123A which is projected outward from the engaging flange 23 provided at the outer end of the spool member 11A by an amount greater than the amount S of sliding movement of the operating rod 123. A coiled spring 126 is provided around the rod 123 between the slide guide 122 and a spring retainer 125 fastened to the rod 23 by a pin 124 to bias the rod 123 toward its outer end at all times. Accordingly, the needles 114 of the needle means 110 are always held projected from the hole 108 but can be retracted thereinto by pushing the operating rod 123 inward.

Figure 13:
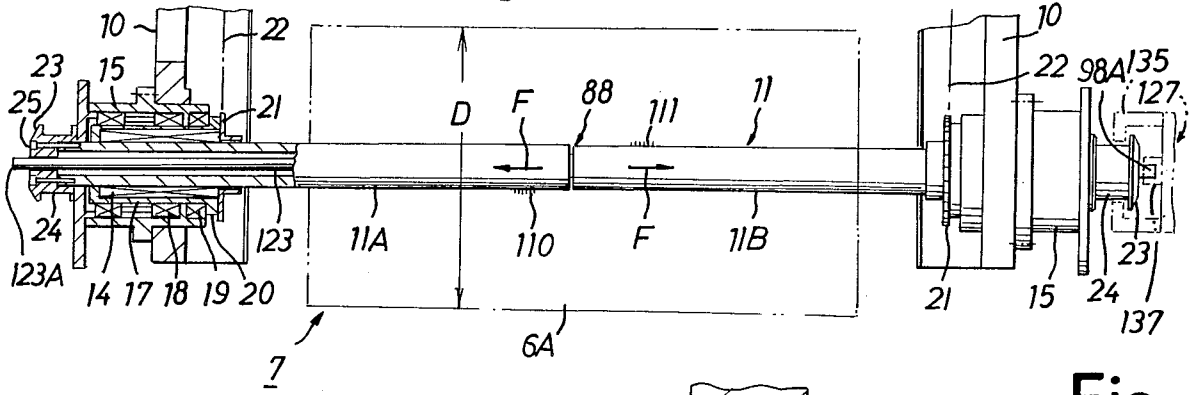
FIG. 13 is a front view partly broken away and showing take-up spool means.
Figure 18:
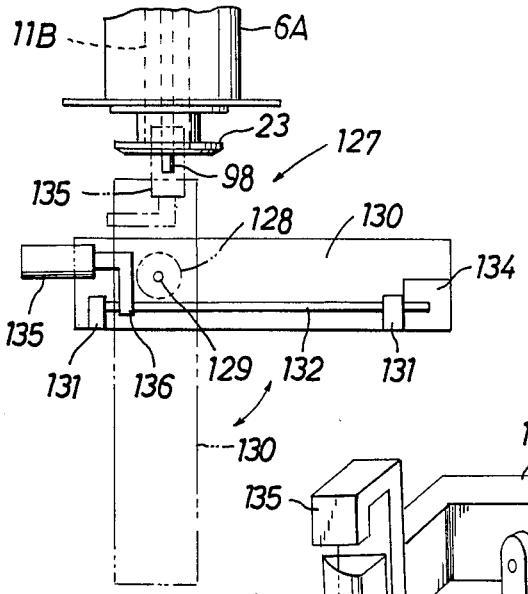
FIG. 18 is a plan view showing spool member withdrawing means.
Figure 19:
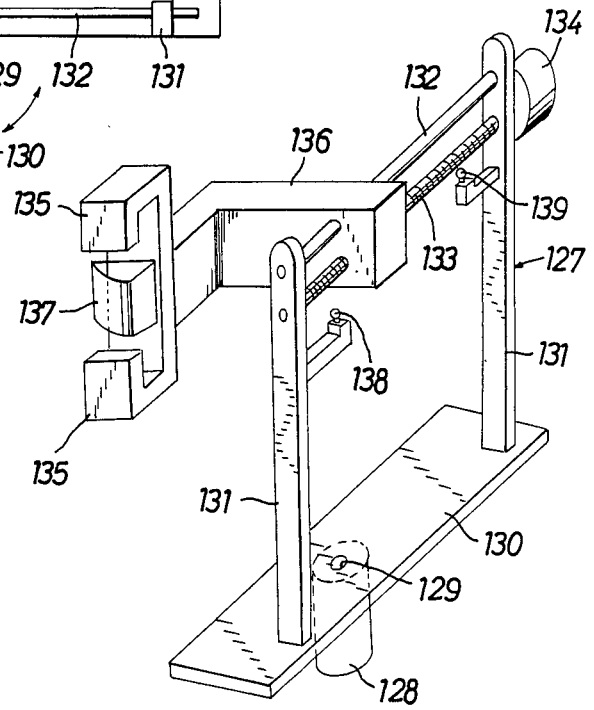
FIG. 19 is a perspective view of the same.

FIGS. 18 and 19 show withdrawing means 127 for withdrawing the spool members 11A (11B) axially thereof by engagement with the engaging flange 23 shown in FIGS. 2, 3 and 13.

The withdrawing means 127 includes a swivel table 130 mounted on the shaft 129 of a swivel motor 128 and adapted to be swiveled about the axis of the shaft 129. Two upright frames 131 provided on the table 130 are spaced apart by a distance greater than the stroke of withdrawal. A tie rod 132 and a screw rod 133 parallel to each other extend between and are supported by the upper ends of the frames 131. The screw rod 133 is driven by a reversible motor 134.

A slider 136 having hook members 135 are mounted on the tie rod 132 and the screw rod 133. A nut member included in the slider 136 is screwed on the screw rod 33. When rotated, the screw rod 133 reciprocatingly moves the slider 136, whereby the divided spool member 11A or 11B is withdrawn, or one of the members is engaged with the other member. The hook members 135 have a pushing cam 137 for slidingly pushing in the operating rod 98 or 123. With the hook members 135 in engagement with the flange 23, the operating rod 98 or 123 is thus pushed in to retract the needle means 110 or 111 and disengage the engagement means 88. The frames 131 are provided with microswitches 138 and 139 opposed to each other to determine the take-up position and widthdrawn position of the spool members 11A, 11B. For this purpose, the switches are actuated by the slider 136 to change the direction of rotation of the motor 134.

Figure 9:
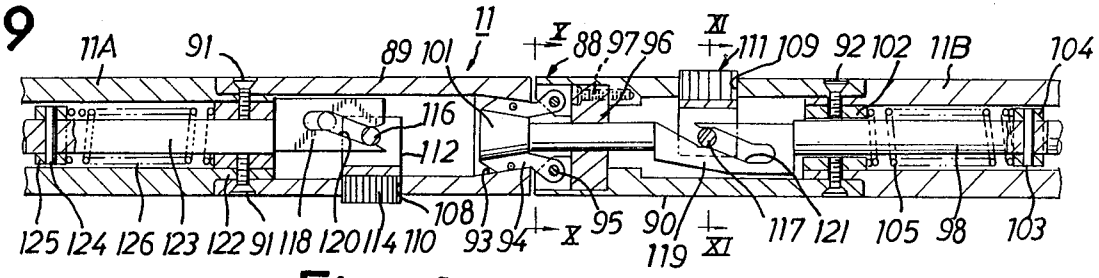
FIG. 9 is a fragmentary view in vertical section showing a take-up spool.

According to the present embodiment, the spool members 11A and 11B are joined together by the engagement means 88, with the needles 114, 115 of the needle means 110, 111 projected from the outer surface of the spool members 11A, 11B as seen in FIG. 9, when the spool means 11 is in condition for rolling up the fabric. The circular fabric 6 knitted by the knitting means and delivered downward therefrom is attached to the needle means 110, 111 on the spool means 11 at the leading end of the fabric, and the spool means 11 is rotated in synchronism with the knitting means for rolling up the fabric.

When the fabric has been rolled up to a full size, the fabric is cut by an unillustrated cutter, and the hook members 135 of the withdrawing means 127 are engaged with the flange 23 at the outer end of the spool member 11A (11B). At this time, the pushing cam 137 pushes in the outer end of the operating rod 123 (98) against the action of the coiled spring 126 (105), causing the cam 118 (119) to retract the needle means 110 (111) from the outer surface of the spool member 11A (11B) and releasing the leading end of the fabric 6A (see FIG. 12). At the same time, the pressing member 101 at the inner end of the rod 98 advances into the spool member 11A to release the engageable members 94 from the pressure, whereupon the ring of coiled spring 107 act to pivotally move the members 94 toward the axis about the pins 95 out of engagement with the engaging portion 93.

The operation described above is effected instantaneously. Subsequently, the hook members 135 draw the spool member 11A (11B) out of the roll 6A. Upon the opposed ends of the spool members 11A, 11B releasing the respective ends of the roll of fabric 6A, the roll 6A falls onto a truck or the like (not shown) positioned under the spool means 11 for delivery. At the same time, the spool members 11A, 11B are pushed in toward each other, causing the engageable members 94 and the pressing member 101 to advance into the engaging portion 93 to join the spool members 11A and 11B end-to-end.

When the engaging flanges 23 are released from the hook members 135, the operating rods 98, 123 are forced outward by the action of the coiled springs 105, 126. Consequently, the engageable members 94 are pressed into engagement with the engaging portion 93 by the pressing member 101, while the cams 118, 119 act to project the needle means 110, 111 from the outer surface of the spool members 11A, 11B, thus rendering the spool means 11 ready for rolling up. The fabric 6 is subsequently rolled up in the same manner as above.

The needle means 110, 111 can be projected from or retracted into the outer surface of the spool members 11A, 11B with the engagement or separation of the spool members 11A, 11B, so that the spool means 11 is simple in construction and operable quickly and reliably and achieves an improved rolling-up operation.

When the divided spool members 11A, 11B are used, no problem will occur in the initial stage of rolling up the fabric, but when the diameter D of the roll of fabric 6A increases, tension builds up to subject the spool members 11A, 11B to great forces acting to separate them away from each other, consequently subjecting the upper ends of the take-up frames 10 to a bending moment as shown in FIG. 13. According to the invention, however, the spool members 11A, 11B are joined together by the engagement means 88 during rolling up and are both supported thereby. This precludes an abnormal bending moment from acting on the frames 10, assuring a high-speed operation.

The spool end portions 89, 90 are connected to the spool members 11A, 11B according to the foregoing embodiment, whereas each spool member may be in the form of an integral piece. The engagement means 88 may be of some other type. For example, the tapered engaging portion may be replaced by a stepped engaging portion for engagement with hooked engageable members. Suitable known means is usable for driving the spool members 11A, 11B.

Furthermore, known means is usable for withdrawing the spool members 11A, 11B. For example, these members can be made axially slidable directly by a screw mechanism or the like. Known means, such as hydraulic or electromagnetic means, can be employed for pushing the operating rods 98, 123.

Figure 15:
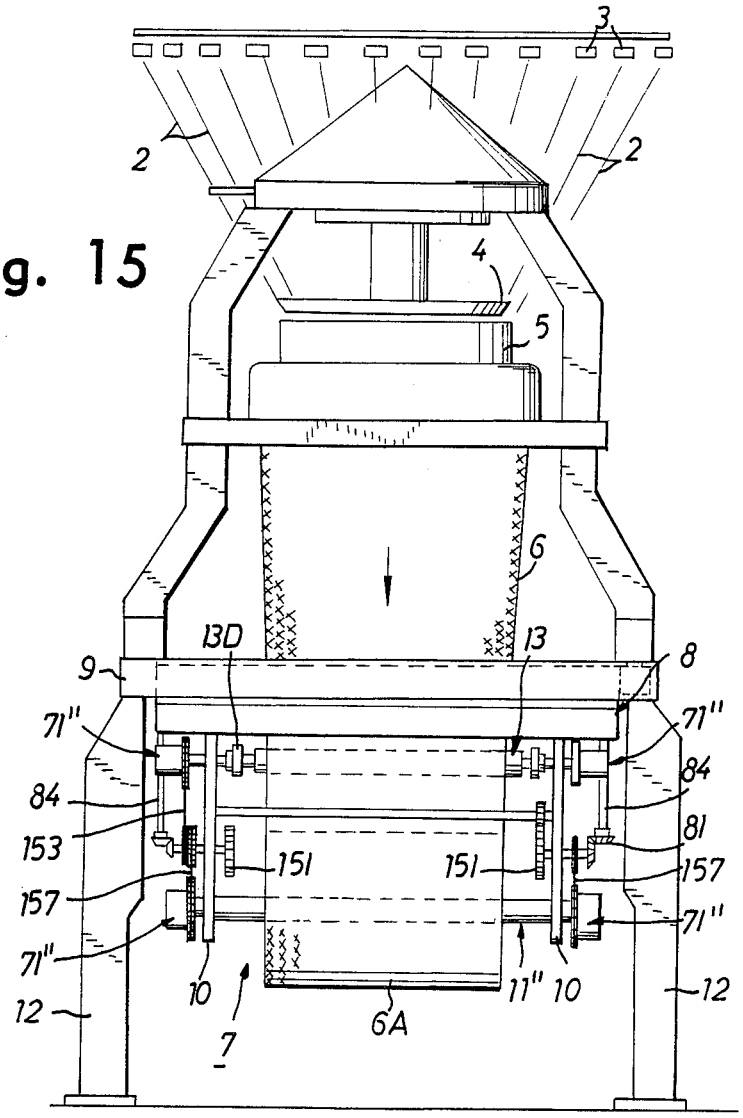
FIG. 15 is a front view showing another circular knitting machine embodying a second embodiment of the invention.
Figure 16:
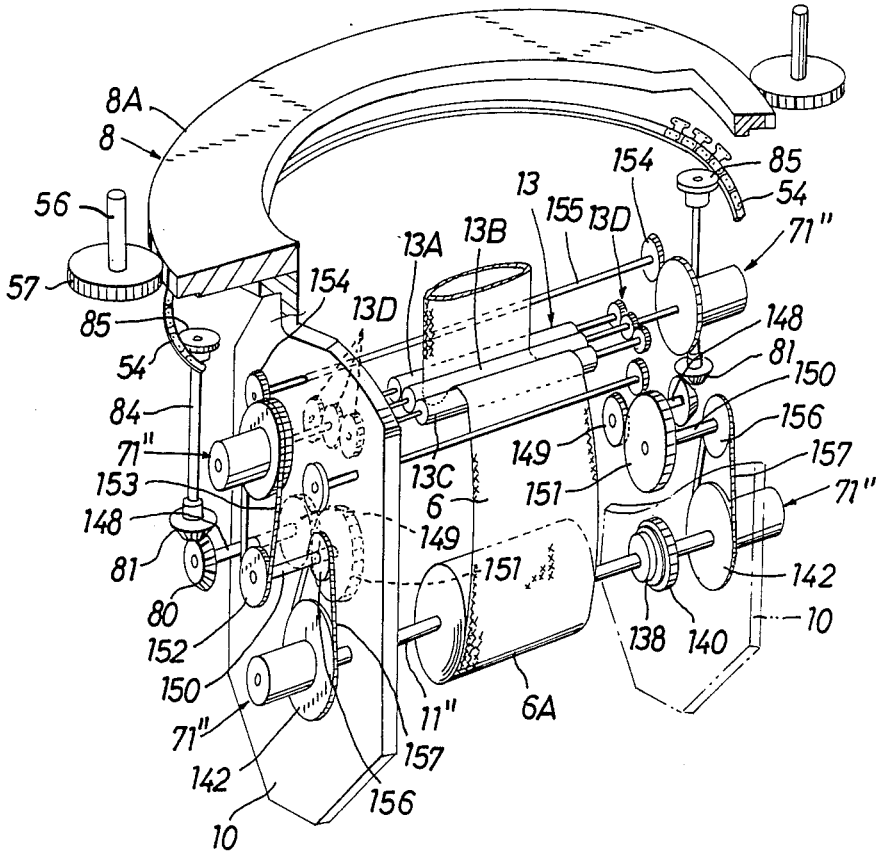
FIG. 16 is a perpective view partly broken away and showing an aspect of the FIG. 15 embodiment.

FIGS. 15 to 17 show an embodiment wherein constant-torque transmission means 71 resorting to a magnetic force are used for driving both the fabric transport means and the take-up spool means.

The constant-torque transmission means 71 can be the one shown in FIG. 7 of FIG. 14. The embodiment of FIGS. 15 to 17 includes transmission means 71″ of the type shown in FIG. 7.

While the drive means for the spool means will be described with reference to FIG. 17, similar drive means is used also for the fabric transport means. The illustrated end of the spool means 11″ is supported by the take-up frame 10 by means of couplings 138, 139 provided with a ratchet wheel 140 and has connected thereto an end shaft 75 supported by a bearing 141 on the frame 10. A drive ring 76″ having a sprocket 142 is mounted by a bearing 143 on the end shaft 75.

The drive ring 76″ has on its outer peripheral portion permanent magnets 77″ arranged on a circumference at a specified spacing and having N poles positioned radially outward and S poles positioned radially inward.

A sleeve 145 positioned outward of the drive ring is mounted by a bearing 144 on the end shaft 75. The sleeve 145 has an externally threaded periphery 146, on which a driven ring 72″ is screwed movably axially thereof. The driven ring 72″ has permanent magnets 79″ arranged on a circumference at a specified spacing and having N poles positioned radially inward and S poles positioned radially outward.

The permanent magnets 79″ on the driven ring 72″ are positioned radially outwardly of, and out of contact with, the permanent magnets 77″ on the drive ring 76″, with the same poles (which are N poles in the present case but can be S poles) opposed to each other and positioned out of phase with each other circumferentially of the rings.

In this illustrated arrangement wherein the radially opposed poles of the magnets 77″, 79″ of the two rings 76″, 72″ are of the same polarity and out of phase circumferentially thereof, torque is transmitted by virtue of magnetic repellence.

Alternatively if the radially opposed poles of the magnets 77″, 79″ of the two rings 76″, 72″ are different in polarity and out of phase (not shown), torque is transmitted by magnetic attraction.

The sleeve 145 has incorporated therein a one-way clutch 147, and the driven ring 72 is mounted on the end shaft 75 with the one-way clutch interposed therebetween. Accordingly, the torque due to the magnetic repellence or attraction of the permanent magnets 77″, 79″ can be transmitted through the clutch 147 to the take-up spool means 11 in the rolling-up direction.

The radially opposed poles of the magnets 77″, 79″ of the drive and driven rings 76″, 72″ are of the same polarity and out of phase circumferentially of the rings, so that when the drive ring 76″ is rotated in the direction of arrow C in FIG. 7, magnetic repellency occurs, whereby the driven ring 72″ is rotated in the direction of arrow C, with a clearance maintained between the opposed magnets as illustrated. Consequently, a constant torque is transmitted to the take-up spool means 11 through the one-way clutch 147 to rotate the means 11 in the specified direction to roll up the fabric 6 on the spool means 11.

With reference to FIGS. 15 and 16, a pair of of constant-torque transmission means 71″ are provided at the respective ends of each shaft concerned. Torque is transmitted to the drive ring 76" in the following manner.

A drive gear 57 is in mesh with a ring gear 8A to rotate the gear 8A. A roller chain 54 movable in circulation along with the gear 8A is provided under the ring gear 8A.

A vertical transmission shaft 84 supported by unillustrated bearings on each take-up frame 10 has a sprocket 85 at its upper end and a bevel gear 81 at its lower end. The sprocket 85 is in mesh with the roller chain 54, so that the transmission shaft 84 rotates or stops with the ring gear 8A.

A first horizontal transmission shaft 148, which is rotatably supported by the frame 10, is provided at its inner end with a spur gear 149 and at its outer end with a bevel gear 80 meshing with the bevel gear 81.

Each of a pair of second horizontal transmission shafts 150 has a reduction gear 151 meshing with the spur gear of the first shaft 148 and a sprocket 152. A chain 153 is reeved around the sprocket 152 and the drive ring sprocket of one of the pair of constant-torque transmission means 71" for the fabric transport means 13. Via an intermediate gear 154, transmission shaft 155, etc., the shaft 150 is further operatively connected to the drive side of the other constant-torque transmission means 71" for the transport means 13.

The fabric transport means 13 comprises three rollers 13A, 13B, 13C which are operatively connected together by gear means 13D. The output shafts (driven shafts) of the pair of transmission means 71" are connected to the respective ends of the central roller 13B. Thus, the fabric 6 is passed over the rollers in a bent form and transported forward.

Each second horizontal transmission shaft 150 carries a sprocket 156 which is operatively connected by a chain 157 to the drive ring sprocket 142 of each constant-torque transmission means 71" for the take-up spool means 11". Thus, the pair of means 71" drive the spool means 11" in the specified direction to roll up the fabric 6 thereon as indicated at 6A as already stated.

Briefly, with the circular knitting machine of FIGS. 15 to 17, a constant torque is magnetically transmitted from the drive transmission means 8 for the take-up frames 10 to the transport means 13 through the pair of constant-torque transmission means 71" to drive the rollers 13A to 13C in the fabric transport direction.

The machine further has another pair of constant-torque transmission means 71" for magnetically transmitting a constant torque from the frame drive transmission means 8 to the take-up spool means 11 to drive the spool means 11 in the fabric rolling-up direction.

FIGS. 20 to 24 show circular knitting machines wherein the drive transmission means 8 for the take-up frames 10 is provided with shock absorber means for controlling the force of inertia of the take-up frame assembly when the machine is brought to a halt. With the exception of this feature, the embodiments shown have the same construction as the foregoing ones, so that the shock absorber means 158 only will be described below.

Figure 21:
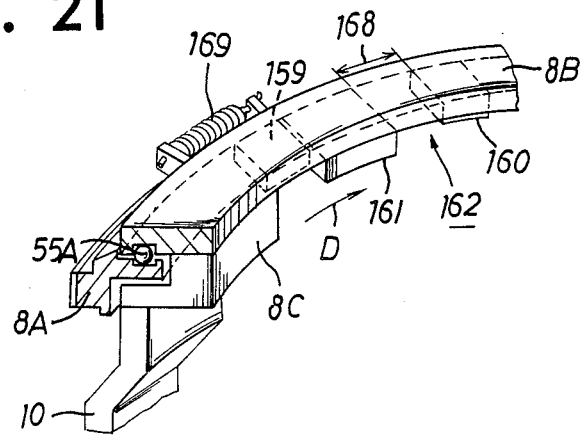
FIGS. 21 and 22 are perspective views showing two examples of shock absorbers.
Figure 22:
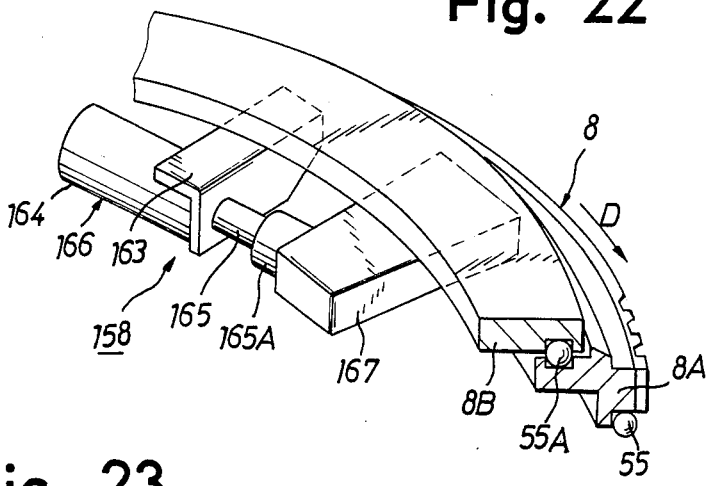
Figure 23:
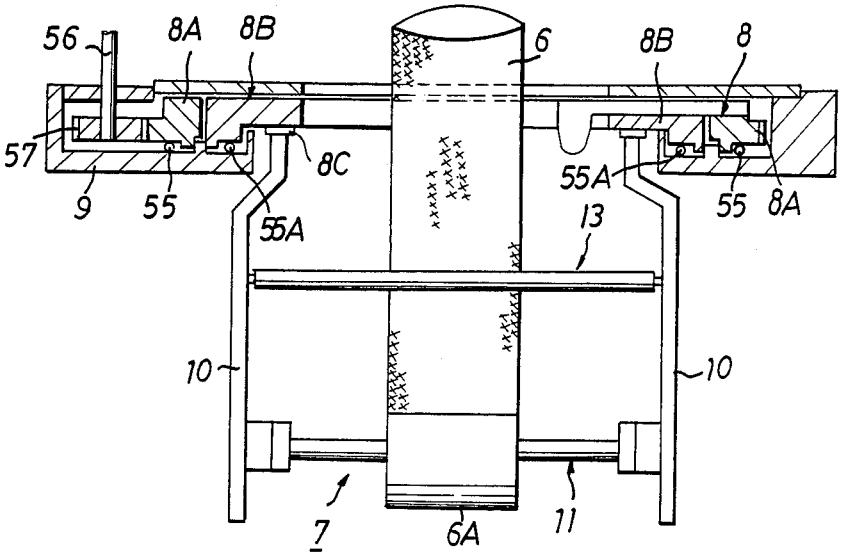
FIG. 23 is an elevation in section showing another example.
Figure 24:
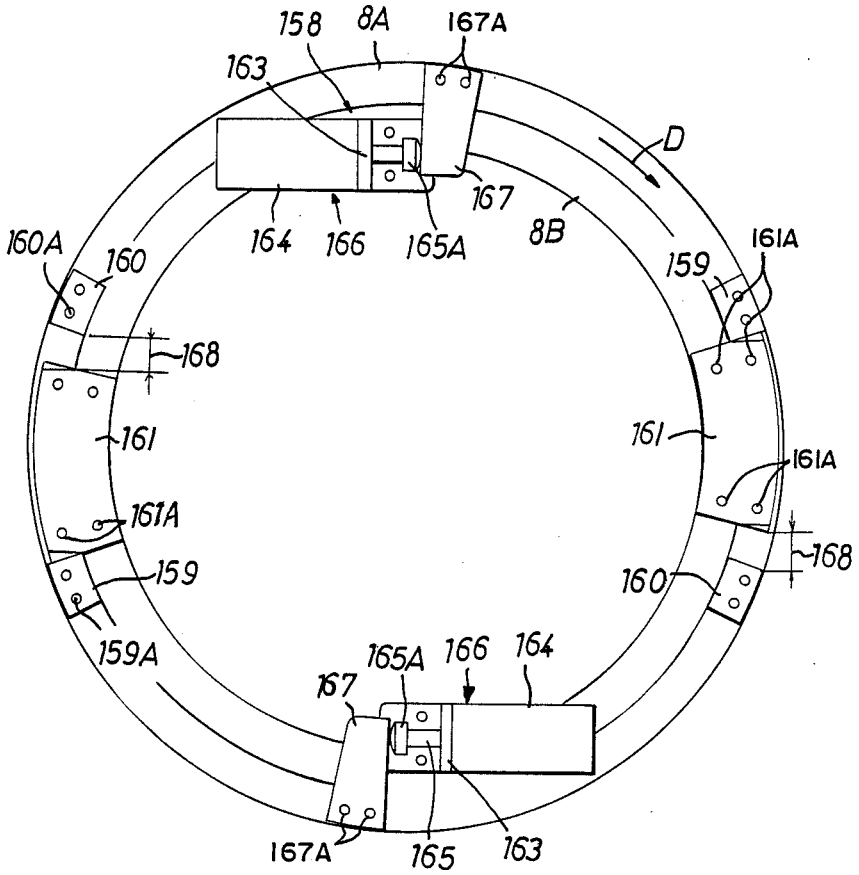
FIG. 24 is a bottom view showing the arrangement the shock absorber means.

With reference to FIG. 24, engaging blocks 159, 160 are fastened to the underside of the ring gear 8A with bolts 159A, 160A, and engageable members 161 each in the form of a bracket or block are fastened to the underside of the take-up base 8B between the blocks 159, 160 with bolts 161A to provide engaging means 162, FIG. 21. Accordingly, when the ring gear 8A is rotated in the direction of arrow D shown in FIG. 24, the engaging blocks 159 come into engagement with the engageable members 161, causing the take-up base 8B, i.e. the take-up frames 10, to rotate about a vertical axis in synchronism with the knitting means.

On the other hand, attached to the take-up base by brackets 163 are shock absorbers 166 each comprising a cylinder tube 164 housing a spring and a liquid pressing piston, and a piston rod 165. The outer end 165A of the piston rod 165 is in contact with an abutment member 167 fastened to the underside of the ring gear 8A with bolts 167A. As seen in FIG. 24, the engaging means 162 and the shock absorber means 158 are arranged about the center of the ring gear 8A at an angular spacing of 90 degrees.

Accordingly, the engaging means 162 causes the take-up frames 10 to rotate in synchronism with the knitting means during the operation of the knitting machine, permitting the fabric to be rolled up at a high speed by the transport means 13 and the spool means 11 without twisting. However, when the machine is stopped, the frames 10 tend to rotate in the direction of arrow D shown in FIG. 24 under inertia although the ring gear 8A stops immediately.

This inertial rotation is controlled by the spring housed in the cylinder tube 164 of the shock absorber 158 and by the hydraulic cushioning effect afforded by the piston in the tube 164. This shock absorbing control permits the frames 10 to stop before the engageable members 161 come into striking contact with the engaging blocks 160 through traveling over an allowance distance 168. Thus, the shock absorber means assures safety even when the knitting machine is operated at a high speed.

The shock absorber means 158 may comprise only the coiled spring 169 shown in FIG. 21.

The take-up base 8B may be fitted to the inner periphery of the ring gear 8A and supported by bearings 55A.

Figure 20:
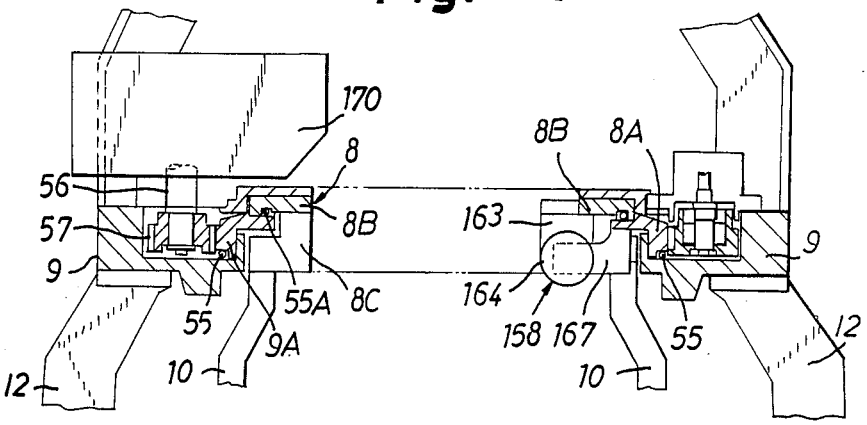
FIG. 20 is a front view partly in development and showing a circular knitting machine having shock-absorber means and embodying the invention.

Indicated at 170 in FIG. 20 is a reduction gear unit.

According to the invention described in detail above, there is provided constant-torque transmission means for magnetically transmitting a constant torque from take-up frame drive transmission means to fabric transport means to drive the rollers thereof in a direction to transport the knitted fabric. This feature renders the machine operable at a higher speed to achieve greatly improved productivity.

The present machine further includes belt transmission means for transmissing power from the drive transmission means to take-up spool means to drive the spool means in a direction to roll up the fabric thereon. The power can therefore be transmitted optimally with increased freedom, such that a reduction in rolling-up tension due to an increase in the diameter of the rolled up fabric can be eliminated by tensioning the belt to ensure a smooth rolling-up operation. The belt transmission means is simple in construction, available economically, less prone to troubles and easy to maintain and inspect.

The take-up spool means comprises a pair of opposed divided hollow spool members. One of the spool members is internally provided with an engaging portion, and the other spool member has engageable portions projecting from its end and movable radially away from its axis. The engageable portions are engageable in the engaging portion and withdrawable therefrom. During rolling-up operation, the spool members are joined together by the engagement means in the form of a single spool as supported at its opposite ends by the take-up frames, so that the frames are subjected to no abnormal bending moment. This assures the machine of safety and durability for a high-speed operation.

Furthermore, the drive transmission means for the take-up frames is provided with shock absorber means for controlling the force of inertia of the frame assembly when the machine is stopped. Accordingly, when the knitting means and the take-up means are brought out of high-speed operation, the take-up frames are prevented from inertial rotation to preclude the fabric from twisting and other irregularities. Since the impact on the fabric take-up assembly is absorbed and mitigated, the machine can be protected from damage.

What is claimed is:

1. A circular knitting machine including rotatable knitting means for forming a tubular knitted fabric; fabric transport means comprising a plurality of rollers for delivering knitted fabric in a hanging state from the knitting means; take-up spool means for rolling up the knitted fabric delivered in a hanging state by the transport means; a pair of opposed take-up frames which are stoppably rotated in synchronism with the knitting means by a drive transmission that is provided at an upper location of the take-up frame and includes a ring gear that is in engagement with a pinion gear; wherein, between the pair of the frames and at an upper location of the frames, the rollers of the fabric transport means are horizontally carried in parallel under the ring gear; and at a lower location of the frames, the take-up spool means is arranged parallel to the rollers of the fabric transport means; said knitting machine further comprising:

a constant-torque transmission means for magnetically transmitting a constant-torque, wherein the constant-torque transmission means comprises a drive ring, a driven ring, and a magnetic slip coupling for transferring rotation of the drive ring to the driven ring due to torque generated by a magnetic interaction between the drive ring and the driven ring which occurs upon rotation of the drive ring and which produces a constant-torque by enabling slippage between the rings when a load over a certain limit is applied to the slip coupling; wherein a mechanical transmission means is provided for rotating the drive ring of the constant-torque transmission means by force derived from rotation of the frames by the engagement between the pinion gear and the ring gear; and wherein said driven ring is coupled to the rollers of the fabric transport means.

2. A knitting machine according to claim 1, wherein a second mechanical transmission means is coupled to the driven ring of the constant-torque transmission means for driving the rollers of the fabric transport means in a feeding direction of the knitted fabric.

3. A knitting machine as defined in claim 1, wherein said drive ring is in the form of a drive disk that is made of magnetic material, said drive ring being secured on a transmission shaft of the mechanical transmission means for rotation therewith, and wherein said driven ring is in the form of a pair of driven disks that are connected together with a clearance therebetween and are supported by bearings on said transmission shaft with the drive disk located within the clearance between the pair of driven disks, and wherein permanent magnets are circumferentially arranged on each of the driven disks in magnetic force interaction with the magnetic material of the drive disk for enabling the driven disks to rotate following the drive disk.

4. A knitting machine according to claim 1, wherein said magnetic slip coupling is formed by permanent magnets that are mounted on the drive ring and the driven ring, the permanent magnets on the drive ring being out of phase with the permanent magnets on the driven ring for enabling rotation of the drive ring to induce rotation of the driven ring by magnetic repulsion.

5. A knitting machine as defined in claim 4, wherein a plurality of permanent magnets are arranged about the periphery of the drive ring and driven ring with a certain circumferential interspace; and wherein the permanent magnets of the drive ring and the permanent magnets of the driven ring are arranged radially with respect to each other with like poles being opposed to and circumferentially out of phase with respect to each other.

6. A knitting machine as defined in claim 2, wherein the rollers of the fabric transport means comprise three rollers that are composed of a central drive roller and two driven rollers which are mounted on slide blocks with one driven roller at each of opposite sides of the drive roller; wherein the three rollers are operatively connected by a gear transmission to roll in the fabric feeding direction; wherein the central driven roller is mounted with a one-way clutch for permitting it to turn in only the fabric feeding direction, said one-way clutch applying force transmitted thereto from the constant-torque transmission means via said second mechanical transmission means to the central roller; and wherein the central roller is provided with a manually operable handle.

7. A knitting machine as defined in claim 1, wherein the constant-torque transmission means is provided on one of the pair of take-up frames, and a belt transmission means for driving the take-up spool means is provided on the other of the pair of take-up frames; and wherein both the constant-torque transmission means and the belt transmission means are driven by rotation of the take-up frames via engagement of the pinion gear with the ring gear.

8. A knitting machine as defined in claim 1, wherein a said mechanical transmission means and a said constant-torque transmission means are connected to each of opposite ends of the fabric transport means; and wherein a said constant-torque transmission means is connected to each of opposite ends of said take-up spool means, a respective second mechanical transmission means interconnecting the drive ring of the constant-torque transmission of each end of the fabric transport means with the drive ring of the constant-torque transmission of the respective end of the take-up spool means.

9. A knitting machine as defined in claim 1, wherein the take-up spool means comprises a pair of spool members, each of which is supported by a respective one of the pair of the frames, said spool members being detachably joined at a central point; wherein a first one of the spool members comprises a socket and a second of the spool members comprises a stud which projects from an end thereof and is radially expansible, the stud being disengageably receivable within the socket.

10. A knitting machine as defined in claim 9, wherein the socket has an engagement part that tapers radially in an axial direction toward the second spool member and the stud is expansible into engagement with the engagement part in a manner coupling the first and second spool members together.

11. A knitting machine as defined in claim 9, wherein the stud is radially expansible by a rod which is slidable within the second spool member and is operable from the outside thereof.

12. A knitting machine as defined in claim, wherein the spool members have respective needle means which are radially movable between positions projecting radially outward from and radially retracted within a peripheral surface of the spool members.

13. A knitting machine as defined in claim 12, wherein rod means, for producing radial movement of the needle means, is slidable inside the spool members.

14. A knitting machine as defined in claim 12, wherein the rod means, for producing radial movement of the needle means, have cam means which act on follower means carried by the needle means; and wherein spring means are wound around the rod means and act to urge the rod means in a direction that project the needle means radially outwardly.

15. A knitting machine as defined in claim 1, wherein the ring gear engaging the pinion gear is rotatably mounted on a support with the aid of a hearing, the pair of take-up frames being secured to an annular take-up base so as to extend downward therefrom, said annular take-up base being disposed on the ring gear so as to be driven thereby; wherein engaging members are secured on the ring gear and on the take-up base by which rotation of the ring gear is transmitted to the take-up base; and wherein abutment members are mounted on the ring gear and shock absorbers are mounted on the take-up base to control inertia of the take-up base when the pinion gear stops.

16. A knitting machine as defined in claim 15, wherein the take-up base is rotatably supported on the ring gear by a bearing.

17. A knitting machine as defined in claim 15, wherein said engaging members comprise engaging blocks and an engageable block, and wherein the shock absorbers are circumferentially arranged on the ring gear at equal intervals.

* * * * *